US005931300A

United States Patent [19]

Sutherland

[11] Patent Number: 5,931,300

[45] Date of Patent: Aug. 3, 1999

[54] WRAP-AROUND CARRIER WITH BAR CODE BLOCKING WEBS

[75] Inventor: Robert L. Sutherland, Kennesaw, Ga.

[73] Assignee: Riverwood International Corporation, Atlanta, Ga.

[21] Appl. No.: 09/080,105

[22] Filed: May 16, 1998

[51] Int. Cl.[6] ..... B65D 65/00

[52] U.S. Cl. ..... 206/427; 206/140; 206/147

[58] Field of Search ..... 206/140, 147, 206/193, 427, 434, 435

[56] References Cited

U.S. PATENT DOCUMENTS

| | | | |
|---|---|---|---|
| 2,383,183 | 8/1945 | Fischer | 206/427 |
| 3,828,926 | 8/1974 | Rossi | 206/427 |
| 4,096,985 | 6/1978 | Wood | 206/427 |
| 4,440,340 | 4/1984 | Bakx | 206/434 |
| 4,875,586 | 10/1989 | Chaussadas | 206/158 |
| 5,060,792 | 10/1991 | Oliff | 206/434 |
| 5,381,891 | 1/1995 | Harris | 206/197 |
| 5,542,536 | 8/1996 | Sutherland | 206/147 |
| 5,609,251 | 3/1997 | Harris | 206/434 |

*Primary Examiner*—David T. Fidei

[57] ABSTRACT

A carrier blank and carrier includes a top panel, first and second opposite ends, and first and second side panels flanking the top panel and foldably connected thereto. First and second bottom panels flank the first and second side panels and are foldably connected thereto. First and second webs are positioned adjacent the first and second opposite ends of the top panel, with the webs each extending between the first and second side panels. The webs are foldably connected to the first and second side panels at fold lines which are parallel to a longitudinal axis extending through the first bottom panel, the first side panel, the top panel, the second side panel, and the second bottom panel. The fold lines are positioned inboard of center lines of outer ones of articles contained in the carrier.

14 Claims, 3 Drawing Sheets

WRAP-AROUND CARRIER WITH BAR CODE BLOCKING WEBS

TECHNICAL FIELD

The present invention relates to wrap-around article carriers and in particular relates to wrap-around carriers which include a panel capable of blocking a pricing code (bar code) printed on the end of articles in the carrier.

BACKGROUND OF THE INVENTION

Certain types of articles, such as containers of food or beverage, are commonly sold both as individual units and in a multi-container package. Each article is normally marked with a pricing bar code to enable it to be scanned and automatically checked at a retail outlet when sold as an individual item. When groups of articles are packaged in conventional open-ended wrap-around carriers, errors can occur if the scanner sees the pricing code on one of the articles and uses that as the price for the entire package instead of the code on the package itself. One way to prevent this from happening is to package the articles in a completely enclosed carton or carrier. However, this is more expensive compared to a wrap-around carrier due to the greater amount of paperboard used in a completely enclosed carrier.

It is desirable to provide wrap-around carriers with end panels of a size sufficient to cover the pricing code on the end articles in the package. Such a design utilizes less paperboard than a fully enclosed carrier and is more economical to produce. Typically, a partial end panel is designed to cover pricing codes located near the bottom of the article and comprises only a short end panel extending up from the bottom panel of the carrier. Ideally, the end panel should be large enough to cover the pricing code of the end articles, should not interfere with the normal fabrication and packaging methods of wrap-around carriers, and should be secure in place after being formed. Preferably, the end panel arrangement should also resist any tendency of the end articles to fall out of the package.

In recent years, a carton manufacturer has manufactured and marketed a carton in Europe having a decorative web extending between and foldably connected to its side panels. However, the web is not reliable for preventing unwanted scanning of bar codes on the articles contained in the carton due in part to the position and size of the web. Moreover, the web can be pulled out of position easily, completely destroying any capability of blocking a bar code. In this regard it is noted that the web attaches to the side panels along fold lines that are positioned substantially exteriorly of the articles contained in the carton and extend at an oblique angle relative to the centerlines of the articles. The attachment arrangement also contributes to the instability of the web.

U.S. Pat. No. 5,542,536 of Sutherland discloses a wrap-around carrier with bar code blocking means in which small partial end panels extend up from the bottom panel for covering the bar codes on the end articles in the package. The partial end panels are each locked in place by gusset panels. The partial end panels are not connected to each other, but are separate items. While the '536 patent represents a noteworthy advance in the art, it yet leaves room for improvement in that additional strength would be desirable in the end panel to better keep the end articles from falling out of the carrier and in that a solution which uses less paperboard would be desirable (to create an end panel of a given height, the '536 patent adds 150% of that height to each side of the carrier blank).

Accordingly, it can be seen that a need yet remains for a wrap-around carrier with a bar code blocking means which reliably obscures the product code, which holds products securely in the carrier, and which uses a minimal amount of paperboard. It is to the provision of such a wrap-around carrier that the present invention is primarily directed.

SUMMARY OF THE INVENTION

Briefly described, in a first preferred form the present invention comprises a carrier blank for forming a wrap-around carrier for containing at least four articles. The carrier blank includes a top panel having first and second opposite ends and first and second side panels flanking the top panel and foldably connected thereto. First and second bottom panels flank the first and second side panels and are foldably connected thereto. First and second webs are positioned adjacent the first and second opposite ends of the top panel, with the webs each extending between the first and second side panels. The webs are foldably connected to the first and second side panels at fold lines which are parallel to a longitudinal axis extending through the first bottom panel, the first side panel, the top panel, the second side panel, and the second bottom panel.

Preferably, article positioning means are formed in the top panel and/or in the first and second side panels and the fold lines are positioned inboard from the first and second opposite ends a distance which is at least as great as from the first and second opposite ends to centerlines of the article positioning means. Most preferably, the fold lines are positioned a distance inboard from the opposite ends of the top panel which is greater than from the first and second ends to centerlines of the article positioning means. Preferably, the fold lines are positioned and configured to pull the webs snug against the articles when the carrier blank is filled and closed.

Preferably, the carrier blank is integrally formed from a unitary piece of paperboard and the webs include bi-fold end portions. Most preferably, the bi-fold end portions each include a medial hinge line or score line oriented to be perpendicular to the fold lines at which the webs are foldably connected to the side panels.

In another preferred form, the present invention comprises a wrap-around carrier, the details of which are similar to the carrier blank just mentioned. Specifically, the wrap-around carrier is adapted for containing at least four articles and includes a top and first and second opposite sides connected to and extending from the top. A bottom extends between the first and second opposite sides and is connected to the sides. First and second webs extend between the first and second sides and are foldably connected thereto along upright fold lines. The upright fold lines are substantially perpendicular to the bottom.

Preferably, outboard ones of the articles contained in the carrier adjacent each web have an article centerline and wherein the article centerlines are outboard of or coextensive with the fold lines.

Preferably, the fold lines are positioned inboard of a centerline of articles contained in the carrier. Most preferably, the webs are integrally formed with the sides of the wrap-around carrier and the fold lines are positioned to pull the webs snugly against the articles when the carrier is filled and closed. Most preferably, the webs include bi-fold end portions which are positioned and adapted to be constrained between the articles and the sides when the carrier is filled with articles and closed. In this way, the webs resist being pulled outwardly as long as articles are contained within the carrier.

Wrap-around carriers and wrap-around carrier blanks according to the present invention have numerous advantages. For example, the carrier and carrier blank are very effective for obscuring the product code and allow adjustment of the height of the web to obscure the product code at different positions on the product. The carrier also holds products very securely therein. It also can be assembled without any glue or adhesive. Importantly, it uses a minimal amount of paperboard. In fact, to obtain a web of a given height, each side of the carrier blank is extended only by a width equal to the height of the web. Thus, there is little or no wasted paperboard as a result of the addition of a web.

The present invention also can be used on conventional equipment using conventional filling and folding techniques. Moreover, the web is strong enough to even lift the carrier when filled with articles. The carrier blank and finished carrier are inexpensive to manufacture, are elegantly simple, and are durable.

Accordingly, it is an object of the present invention to provide a wrap-around carrier and carrier blank which is effective for obscuring a product code of an article contained within the carrier.

It is another object of the present invention to provide a wrap-around carrier and carrier blank which can be configured, with slight changes in the position of one or more features, to accommodate products having product codes at high or low positions.

It is another object of the present invention to provide a wrap-around carrier and carrier blank which is effective for holding products securely therein.

It is another object of the present invention to provide a wrap-around carrier and carrier blank which uses a minimal amount of paperboard.

It is another object of the present invention to provide a wrap-around carrier and carrier blank which can be used on conventional equipment using conventional techniques.

It is another object of the present invention to provide a wrap-around carrier and carrier blank which is inexpensive, simple, and durable.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
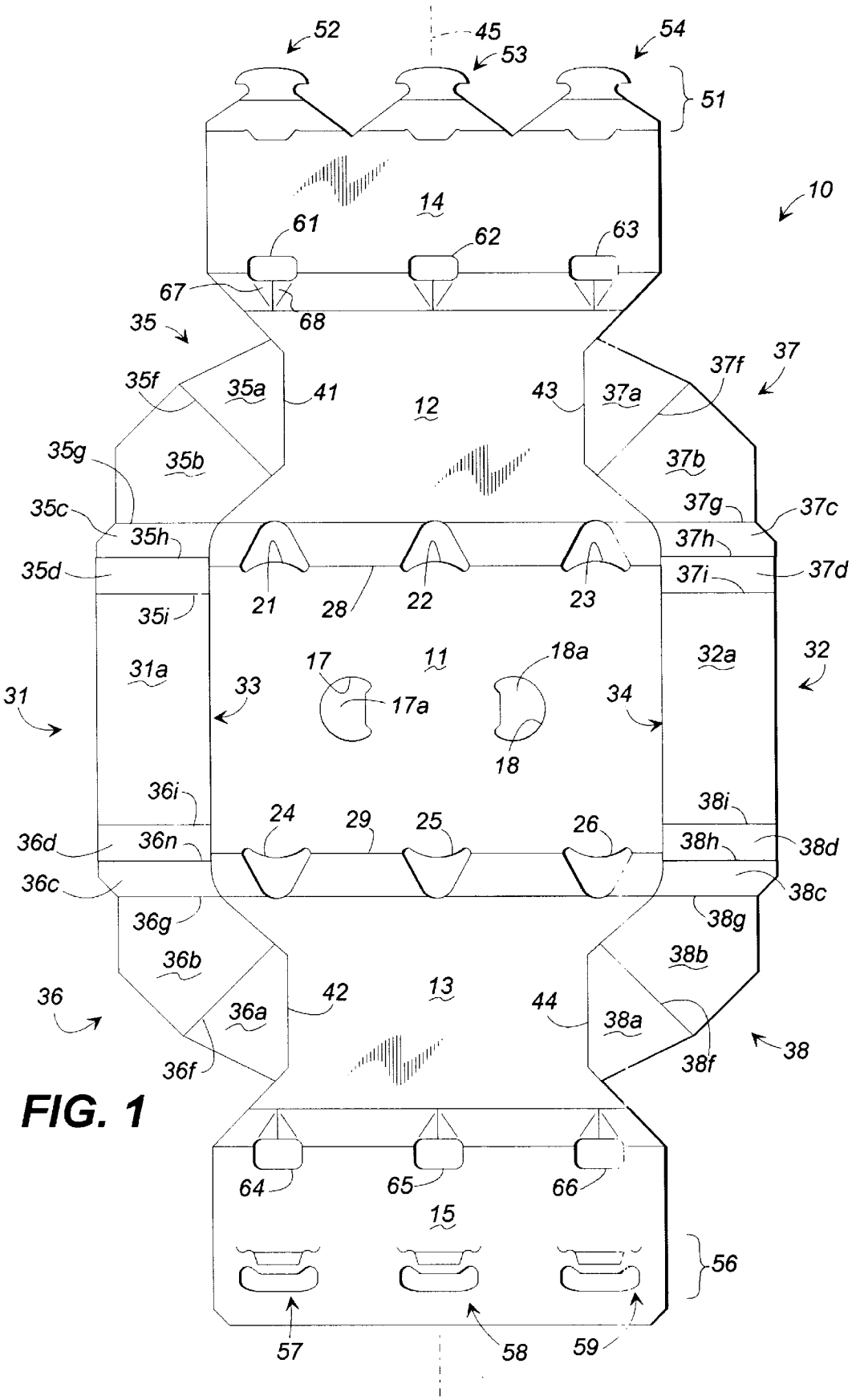
FIG. 1 is a plan view of a carrier blank according to a preferred form of the invention.
Figure 2:
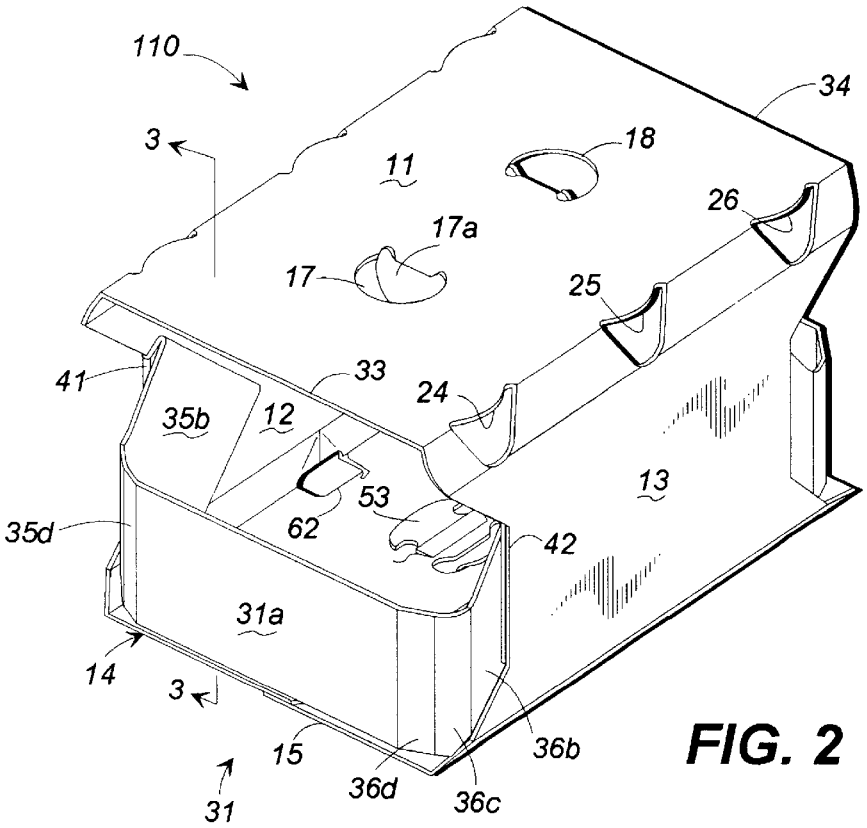
FIG. 2 is a perspective illustration of a filled and closed carrier made using the carrier blank of FIG. 1 (shown with articles contained therein omitted for clarity).

Referring now in detail to the drawing figures, wherein like reference numerals depict like parts throughout the several views, FIG. 1 shows a carrier blank 10 for forming a wrap-around carrier 110 as shown in FIG. 2. The carrier blank 10 includes a top panel 11 connected to and flanked by first and second side panels 12 and 13, which in turn are connected to and flanked by first and second bottom panels 14 and 15. The top panel 11 is substantially rectangular and has finger holes 17 and 18 temporarily filled with finger flaps 17*a*, 18*a*. Article positioning cut-outs 21–26 are positioned along side edges 28 and 29 of the top panel. The side panels 12 and 13 are foldably connected to the top panel 11 along score lines formed at the side edges 28 and 29. In the illustrative embodiment depicted in the drawing figures, a 2×3 arrangement is shown and is shown in particular for use in containing cans. Of course, those skilled in the art will recognize that the principles of the present invention can be applied to a wrap-around carrier for bottles as well, with only minor modifications.

A pair of webs 31 and 32 are positioned adjacent opposite end edges 33 and 34 of top panel 11. In the carrier blank 10, the webs 31 and 32 include a central web panel 31*a* and 32*a* which are temporarily attached to the top panel 11 by small nicks of paperboard. With the exception of these small nicks connecting the central web panels to the top panel, the central web panels are completely detached therefrom. The webs 31 and 32 also each include a pair of wing portions, such as wing portions 35, 36, and 37, 38. These wing portions are hingedly attached to the side panels 12 and 13 at fold lines 41–44. It should be noted that fold lines 41 and 42 are coextensive with each other, as are fold lines 43 and 44. Moreover, fold lines 41 and 42 are parallel with fold lines 43 and 44 and all are parallel to a longitudinal axis 45 extending through the bottom panels, the side panels, and the top panel. As can be seen in this figure, and as will be described in more detail in connection with FIG. 3, the fold lines are positioned inboard of the middle of the article positioning cut-outs. For example, fold lines 41 and 42 are positioned inboard of the center of article positioning cut-outs 21 and 24. Likewise, fold lines 43 and 44 are positioned inboard of the center of article positioning cut-outs 23 and 26.

Each of the wing portions includes a substantially delta-shaped flap 35*a*, 36*a*, 37*a*, and 38*a*. The wing portions each also includes a five-sided flap 35*b*–38*b*, and small comer flaps 35*c*–38*c* and 35*d*–38*d*. The delta-shaped flaps 35*a*–38*a* are hingedly connected to the five-sided flaps 35*b*–38*b* along hinge lines or fold lines 35*f*–38*f*. In the illustrative embodiment, hinge lines 35*f*–38*f* preferably are each oriented at a 40° angle with respect to the fold lines 41–44. Together, the delta-shaped flaps and the five-sided flaps make up a bi-fold portion of the webs. The comer panels 35*c*–38*c* and 35*d*–38*d* include score lines 35*g*–38*g*, 35*h*–38*h*, and 35*i*–38*i*, to allow folding or bending thereof. These triplets of score lines each extend perpendicularly relative to central web panels 31*a*, 32*a*. This allows the web to conform more tightly to the contour of a can or bottle contained in the carrier.

The bottom panel 14 includes a male locking portion 51 at a distal edge thereof. The male locking portion 51 includes male locking tabs 52–54. The other bottom panel 15 includes female locking means 56, including female lock openings indicated generally at 57–59. Such locking mechanisms are well-known in the industry and further discussion of same is unnecessary here.

Each of the bottom panels 14, 15 also includes a triplet of openings 61–63, 64–66. These openings serve dual functions. Firstly, they allow fingers of the filling machines to pull downwardly on the side panels during the filling and closing of the carrier blank. Secondly, the openings also receive a portion of the heel of the bottle or can contained thereadjacent to help positively position the article. In this regard, each of the openings includes a pair of small, triangular flaps associated therewith for helping to accommodate the shape of the bottle or can. For example, opening 61 has associated therewith first and second small triangular flaps 67 and 68.

One can adjust the position of the webs in the finished product (in the folded and closed carrier) by making slight adjustments in the position of the score lines 41–44. For example, one can move the fold lines 41–44 outwardly away from each other along the longitudinal direction to lower the webs. In other words, fold lines 41 and 43 can be moved away from fold lines 42 and 44 and vice-versa to lower the position of the webs in the finished carrier. Conversely, the fold lines 41 and 43 can be moved closer to fold lines 42 and 44 and vice-versa in order to raise the webs in the folded and closed carrier. Also, the lateral position of the fold lines can be adjusted to make the webs less or more snug against the bottles or cans contained in the carrier. For example, fold lines 41 and 43 can be moved closer toward each other, as can fold lines 42 and 44, in order to make the webs fit more snugly and tightly against the bottles or cans contained in the carrier. On the other hand, fold lines 41 and 43 can be moved farther away from each other, as well as fold lines 42 and 44 moved farther away from each other in order to loosen the webs.

FIG. 2 shows a carrier 110 folded and filled from the carrier blank 10 of FIG. 1. It should be noted, however, that in FIG. 2 the cans or bottles contained therein have been omitted for clarity to allow the reader to better visualize the interior of the folded and closed carrier. As can be appreciated from FIG. 2, one can see that the webs, such as web 31, extend from the side panels 12 and 13 and are foldably connected thereto. The webs are positioned such that they block a lower portion of the bottles or cans contained therein to prevent bar code labels on the bottles or cans from being scanned by scanning equipment. Moreover, as can be seen in FIG. 2, the bi-fold portions of the webs, such as bi-fold 35*b*, lie flat against the inside surfaces of the side panels, such as side panel 12, and are held in such configuration by the existence of the cans or bottles in the carrier. In this way, the bi-folds are constrained against unfolding as they are captured one side by the interior surface of the side panel and are captured on the other side by the exterior surface of the can or bottle. In this way, the webs resist being unfolded as long as the cans or bottles remain in the carrier, thus providing for a strong web which is not readily pulled out.

Figure 3:
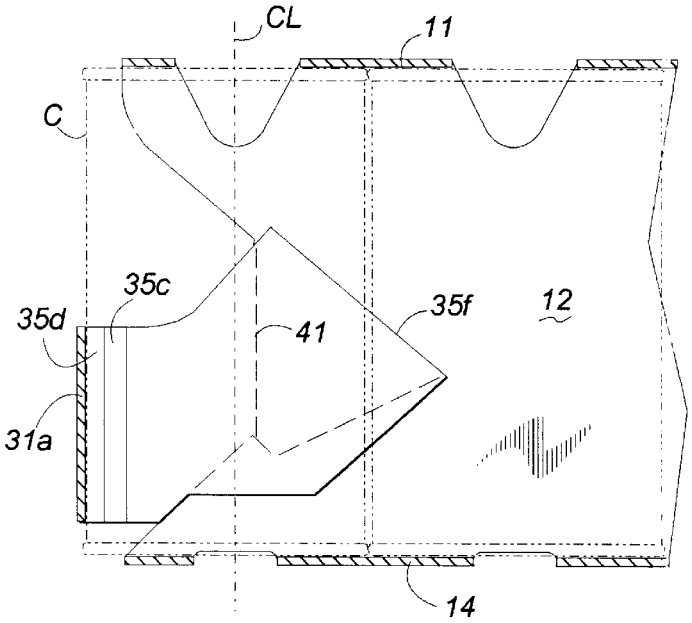
FIG. 3 is a side elevation view of the carrier of FIG. 2, viewed along view lines 3—3.

FIG. 3 shows a view taken from inside the carrier of FIG. 2, taken along view lines 3—3. As shown in FIG. 3, the fold lines, such as fold line 41, are positioned inboard of a center line CL of an outer can C (the outer can C is shown in shadow line, as is an adjacent can). Alternatively, the fold line 41 could be moved to be substantially coextensive with the center line CL of the outer can C. However, if the fold line 41 is moved to be outboard of the center line CL of the outer can C, one of the important advantages of the present invention would be lost inasmuch as the bi-fold would no longer be as well constrained by the can and the inside surface of the side panel. Thus, the web would be more easily pulled open.

Figure 4:
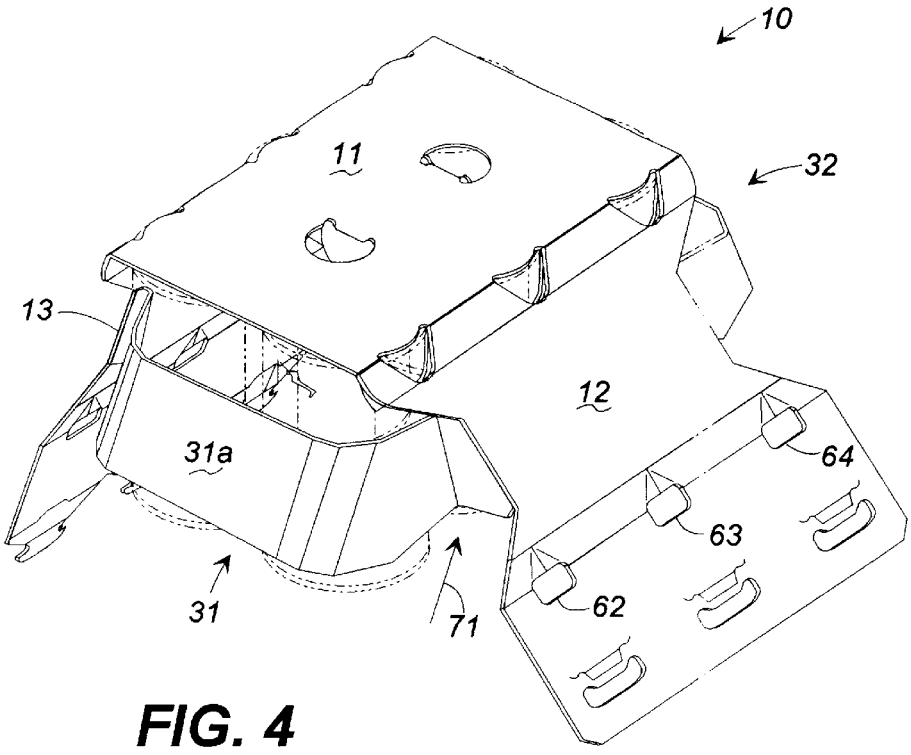
FIG. 4 and 5 are schematic, perspective illustrations of a folding and filling operation for converting the carrier blank of FIG. 1 to the filled and closed carrier of FIG. 2.
Figure 5:
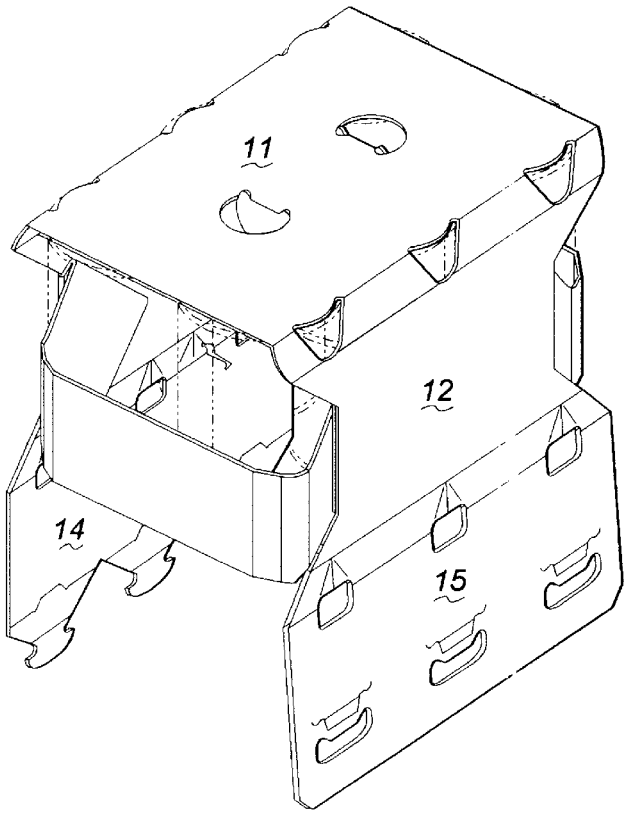

Referring now to FIGS. 4 and 5, the filling and closing of the carrier blank 10 to achieve the filled and closed carrier of FIG. 2 is depicted. First, the carrier blank 10, while still in a flat configuration, is pulled downwardly onto a 2×3 group of cans or bottles, such that the underside of central panel 11 contacts the top surfaces of the cans. The webs 31 and 32 are pulled downwardly to break away from the central panel 11 and move towards the cans thereunder. The bi-folds are pushed inwardly, such as in the direction of direction arrow 71, to cause the bi-folds to fold, thereby drawing the central panels, such as central panel 31*a*, more closely toward the cans. Fingers of the filling machinery grip the finger openings, such as finger openings 62–65, to pull the side panels 12 and 13 downwardly and against the sides of the can. In this way, the configuration of FIG. 5 is achieved. To finish filling and closing the carrier blank of FIG. 5, all that remains is to fold the bottom panels 14 and 15 towards each other and to lock them together using the male locking tabs and female lock openings.

While the invention has been shown and described in preferred forms, it will be apparent to those skilled in the art that many modifications, additions, and subtractions can be made therein without departing from the spirit and scope of the invention as set forth in the following claims.

I claim:

1. A carrier for forming a wrap-around carrier for containing at least four articles, said carrier blank comprising:

a top panel having first and second opposite ends;

first and second side panels flanking said top panel and foldably connected thereto;

first and second bottom panels flanking said first and second side panels and foldably connected thereto;

first and second webs adjacent first and second opposite ends of said top panel, said webs each extending between said first and second side panels and being foldably connected to said first and second side panels at fold lines, and wherein said fold lines are parallel to a longitudinal axis extending through said first bottom panel, said first side panel, said top panel, said second side panel, and said second bottom panel; and a plurality of article positioning means formed at least in part in said top panel, said plurality of positioning means including first and second article positioning means adjacent said first end of said top panel and third and fourth article positioning means adjacent said second end of said top panel, and wherein said fold lines are positioned inboard from said first and second opposite ends by a distance at least as great as from said first and second opposite ends to centerlines of said article positioning means.

2. A carrier blank as claimed in claim 1 wherein said fold lines are positioned inboard from said first and second opposite ends by a distance greater than from said first and second opposite ends to centerlines of said article positioning means.

3. A carrier blank as claimed in claim 1 wherein said fold lines are positioned to pull said webs snug against the articles when the said carrier blank is filled and closed.

4. A carrier blank as claimed in claim 1 wherein said webs are adapted to cover a lower portion of the articles to obscure product code labels positioned on a lower portion of the articles.

5. A carrier blank as claimed in claim 1 wherein said webs include bi-fold end portions.

6. A carrier blank as claimed in claim 6 wherein said bi-fold end portions each include a medial hinge line oriented to be at an oblique angle to said fold lines at which said webs are foldably connected to said side panels.

7. A carrier blank as claimed in claim 5 wherein said bi-fold end portions are positioned and adapted to be constrained between articles and said side panels when said carrier blank is filled with articles and closed.

8. A carrier blank as claimed in claim 1 wherein said carrier blank is integrally formed from a unitary piece of paperboard.

9. A carrier blank as claimed in claim 1 further comprising lock means formed in said first and second bottom panels for locking said first bottom panel to said second bottom panel.

10. A wrap-around carrier for containing at least four articles, said wrap-around carrier comprising:

a top;

first and second opposite sides connected to and extending from said top;

a bottom extending between and connected to said first and second opposite sides;

article positioning cutouts, formed at least in part in said top panel, through which a portion of the top of each article extends; and first and second webs extending bet ween said first and second opposite sides and foldably connected thereto along upright fold lines, and wherein said upright fold lines are substantially perpendicular to said bottom and parallel to the verticle axis of said articles, the outboard ones of the articles adjacent each web having an article centerline and said fold lines are positioned inboard of said article centerline and said article positioning cutout centerline.

11. A wrap-around carrier as claimed in claim 10 wherein said fold lines are positioned such that with articles contained in the carrier, said webs are pulled snug against the articles.

12. A wrap-around carrier as claimed in claim 10 wherein said webs include bi-fold end portions which are positioned to be constrained between articles contained in said wrap-around carrier and said side panels.

13. A wrap-around carrier as claimed in claim 10 wherein said carrier is integrally formed from a unitary piece of paperboard.

14. A wrap-around carrier as claimed in claim 10 wherein said webs include bi-fold end portions each including a medial score line oriented to be at an acute angle relative to said fold lines at which said webs are foldably connected to said side panels.

* * * * *